US005411113A

United States Patent [19]

Lubinski

[11] Patent Number: 5,411,113

[45] Date of Patent: May 2, 1995

[54] ALUMINUM SCAFFOLD SYSTEM

[76] Inventor: Ronald Lubinski, 40 Centenial Heights Ct., Meaford, Ontario, Canada, L0H 1Y8

[21] Appl. No.: 928,336

[22] Filed: Aug. 12, 1992

Related U.S. Application Data

[63] Continuation-in-part of Ser. No. 729,150, Jul. 12, 1991, abandoned.

[51] Int. Cl.[6] ..... E04G 7/14

[52] U.S. Cl. ..... 182/179; 403/49

[58] Field of Search ..... 182/179, 178; 52/648, 52/637, 638, 645, 646; 403/49, 109, 359

[56] References Cited

U.S. PATENT DOCUMENTS

| | | | |
|---|---|---|---|
| 1,460,928 | 7/1923 | Tilden . | |
| 2,303,428 | 12/1942 | Black . | |
| 2,508,832 | 5/1950 | McAninch | 403/359 |
| 3,420,557 | 1/1969 | Frances et al. . | |
| 3,432,916 | 3/1969 | Fisher et al. . | |
| 3,608,685 | 9/1971 | Childress | 403/359 X |
| 3,817,641 | 6/1974 | Steele et al. . | |
| 4,248,544 | 2/1981 | McKane | 403/49 |
| 4,394,095 | 7/1983 | Layher . | |
| 4,426,171 | 1/1984 | Layher . | |
| 4,493,578 | 1/1985 | D'Alessio . | |
| 4,514,940 | 5/1985 | Manderla . | |
| 4,525,096 | 6/1985 | Green et al. . | |
| 4,576,500 | 3/1986 | Wong . | |
| 4,603,756 | 8/1986 | Layher . | |
| 4,630,498 | 12/1986 | Santi . | |
| 4,718,787 | 1/1988 | Bahloul | 182/179 X |
| 5,024,037 | 6/1991 | Ono . | |

FOREIGN PATENT DOCUMENTS

| | | | |
|---|---|---|---|
| 1170694 | 7/1984 | Canada . | |
| 1256148 | 6/1989 | Canada . | |
| 1270020 | 6/1990 | Canada . | |
| 0049096 | 4/1982 | European Pat. Off. . | |
| 0408209 | 1/1991 | European Pat. Off. . | |
| 2474087 | 7/1981 | France . | |
| 2484507 | 12/1981 | France . | |
| 2553456 | 4/1985 | France | 403/49 |
| 1112673 | 8/1961 | Germany . | |
| 3318363 | 11/1984 | Germany . | |
| 435761 | 9/1935 | United Kingdom . | |
| 1278243 | 6/1972 | United Kingdom . | |

*Primary Examiner*—Alvin C. Chin-Shue
*Attorney, Agent, or Firm*—Mirek A. Waraksa

[57] ABSTRACT

A scaffold comprises uprights and transverse tubular braces formed of aluminum. Each upright includes a tubular post extruded with external alignment grooves. Identical aluminum flange assemblies are spaced apart along the post. Each flange assembly includes an extruded sleeve with internal aligning ribs that interlock with the external grooves of the post, and a flange cast with internal ribs that interlock with external alignment grooves extruded with the sleeve. Flange decreases continuously from a central part to its periphery. A set of wedge-receiving openings is formed between the central part and periphery. A brace carries an aluminum connector having upper and lower sections that define a mouth for receiving the flange. An outer part of the mouth mates with inclined upper and lower surfaces of the central part of the flange. An inner part of the mouth remains clear of the flange so that shear forces and bending moments are applied by the brace to the thicker central part of the flange. The connector sections have aligned openings that register with an opening in the flange, and a wedge is inserted that secures the joint.

18 Claims, 9 Drawing Sheets

ALUMINUM SCAFFOLD SYSTEM

This is a continuation-in-part of U.S. patent application No. 729,150, filed on Jul. 12, 1991, now abandoned.

FIELD OF THE INVENTION

The invention relates to scaffolds, and more particularly, to scaffolds with a predominantly aluminum construction.

BACKGROUND OF THE INVENTION

A variety of metal scaffolds are known. The present invention relates specifically to modular scaffold systems whose principal components are vertical uprights carrying horizontal flanges and transverse braces carrying connectors that cooperate with the flanges. Each flange will typically have a set of openings in a predetermined spacing arrangement that permit braces to be receive at different angles. Each connector will typically have upper and lower sections defining a mouth that receives a flange and aligned openings that register with one of the flange openings. A wedge is inserted through the registered openings to secure the joint between the brace and the upright. In some systems, the wedge may force leading surfaces of the connector into a friction lock with the upright. The friction lock is intended to reduce shear and bending forces that might otherwise be applied to the flange through the brace. Several similar flanges are welded at intervals to the upright to permit fastening of braces at various locations.

Such scaffolds have been constructed of steel. Examples of such scaffolds are to be found in U.S. Pat. No. 4,044,523 to Layher, U.S. Pat. No. 4,493,578 to D'Alessio, and U.S. Pat. No. 4,840,513 to Hackett. To the knowledge of the present inventor, no aluminum scaffold system of similar overall configuration has been successfully commercialized.

The present specification proposes a scaffold with a predominantly aluminum construction. One immediate and readily expected advantage is a reduction in the weight of the braces and uprights. However, aluminum poses unique problems. In particular, welding an aluminum flange to a tubular aluminum post can significantly weaken the post. The Canadian Standards Association typically ascribes a 40% reduction in load-bearing capacity once any significant weld is formed on such posts. Multiple flanges should, of course, be vertically registered (specifically their vertical openings). Irregularities may otherwise prevent braces from properly meeting with flanges when braces are joined between pairs of uprights. One problem in that regard is that aluminum is not a "forgiving" material. Any re-working of the position of a flange, particularly additional welding, is apt to significantly weaken the associated post. The weakness of aluminum relative to steel also creates the risk of snapping flanges in response to loads applied through braces connected to a flange. Loose fits between brace connectors and flanges may cause wear in relatively soft aluminum materials. Simply increasing overall dimensions and the quantity of aluminum in scaffold components is not a truly viable solution, as the resulting system is apt to be at a significant cost disadvantage relative to conventional steel systems. Various aspects of the present invention address such problems.

SUMMARY OF THE INVENTION

In one aspect, the invention provides a scaffold comprising a plurality of uprights. Each upright includes a tubular aluminum post extruded with an aligning structure along its exterior, and a plurality of flange assemblies. Each flange assembly has an aluminum sleeve located about the associated post, an annular aluminum flange mounted about the sleeve and formed with a set of openings in a predetermined spacing arrangement, and means securing the sleeve to the associated post. The sleeve is extruded internally with an aligning structure that is complementary to and interlocked with the aligning structure of the associated post, essentially ensuring registration of the sets of opening of the flange assemblies. The sleeve is preferably extruded with external aligning structure that cooperates with complementary aligning structure formed on the flange, to further constrain the orientation of the sets of apertures. The flange is preferably secured to the sleeve solely with annular aluminum retainers that are butted against opposing faces of the flange and then welded to the sleeve. This ensures that the strength of the flange is not compromised.

A slot may be formed in the sleeve of each flange assembly to receive a weld bead that secures the sleeve to the associated post. The sleeve not only mounts the flange assembly to the post in a particular orientation, but also reinforces the post precisely in the region where it is weakened by welding. Although relatively permanent fastening is possible, the flange assemblies are preferably secured in a releasable fashion to the associated post, allowing for positioning as required. Several releasable fastening means are described below.

Elongate braces may be used to join the uprights. Each brace or cross-member may comprise a pair of end connectors. Each connector may comprise a mouth portion shaped to receive a flange, a pair of aligned openings in the mouth portion positioned to register with one opening of the received flange, and a wedge shaped for insertion through the registered openings. The thickness of the flange may be tapered, placing more material proximate to the post and less proximate to the periphery of the flange. The mouth portion of the connector may be shaped to mate with the flange at its thicker central portion, radially inset from the flange openings. This reduces the effect of bending forces, increasing the capacity of the flange to withstand snapping, for a given amount of constituent aluminum. Where annular retainers are used to secure the flange to the sleeve, the retainers may be formed with inclined surfaces that mate in a similar manner with the seated connector, avoiding application of significant bending moments to the flange.

Various features of the invention have been summarized above in the context of an overall scaffold system. Other features will be apparent from a description below of preferred embodiments of the invention and will be more specifically defined in the appended claims.

DESCRIPTION OF THE DRAWINGS

The invention will be better understood with reference to drawings illustrating preferred embodiments in which.

DESCRIPTION OF PREFERRED EMBODIMENT

Figure 1:
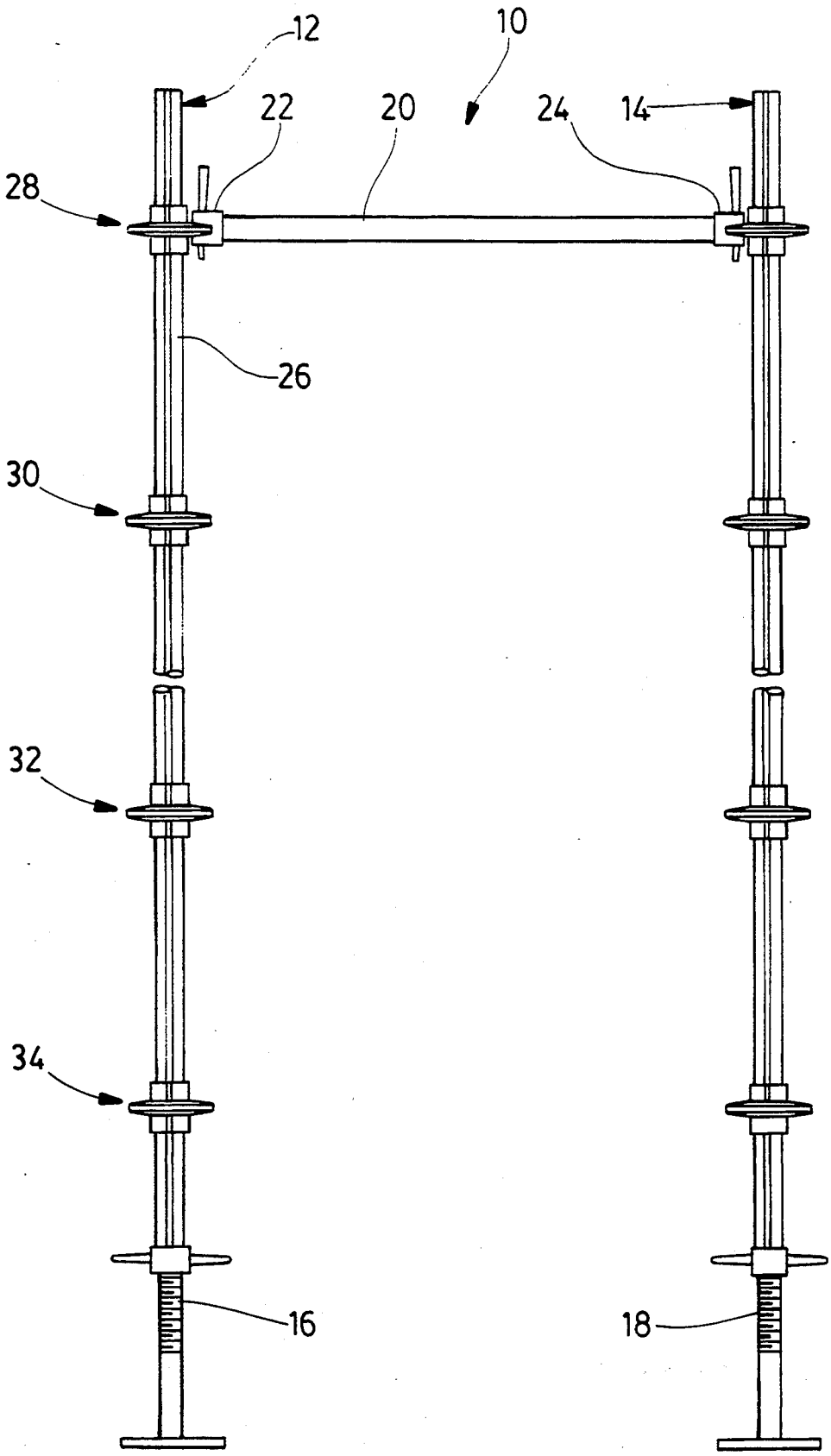
FIG. 1 is a side elevational view of portions of a scaffold.
Figure 2:
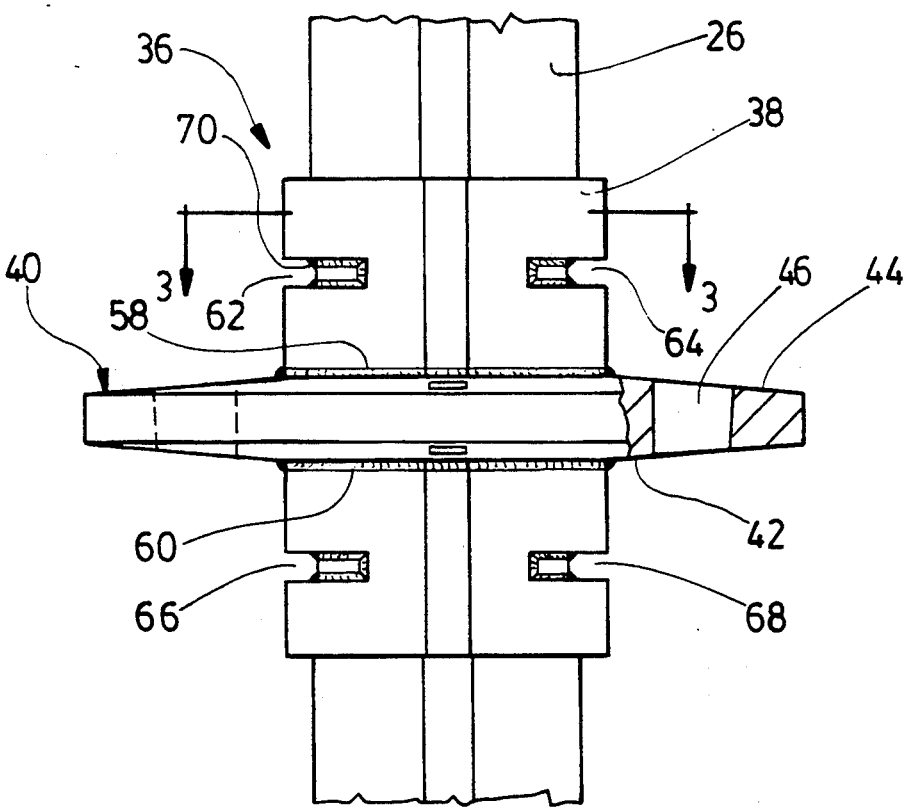
FIG. 2 is a fragmented elevational view of a flange assembly mounted on an upright of the scaffold.
Figure 3:
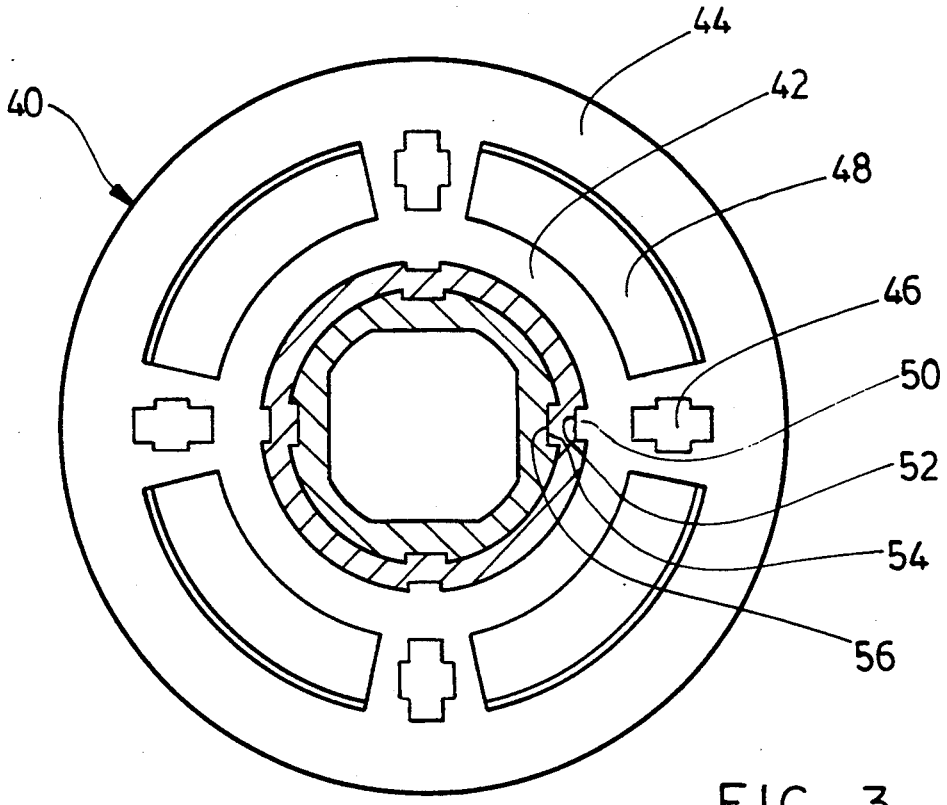
FIG. 3 is a sectional view along lines 3—3 of FIG. 2 further detailing the mounting of the flange assembly.

Reference is made to FIG. 1 which illustrates portions of a scaffold 10 embodying various aspects of the invention. The scaffold 10 includes two uprights 12, 14 mounted on vertically adjustable footings 16, 18 and a transverse brace 20 that extends between the two uprights 12, 14. The brace 20 has a pair of connectors 22, 24, one at either end thereof, that are used to secure the brace 20 to the uprights 12, 14. The uprights, braces, and connectors of the scaffold 10 are formed of aluminum, preferably containing small quantities of magnesium. It will be appreciated that the complete scaffold 10 would actually comprise a far larger number of uprights and braces than have been illustrated and might form a rectangular gridwork.

Figure 4:
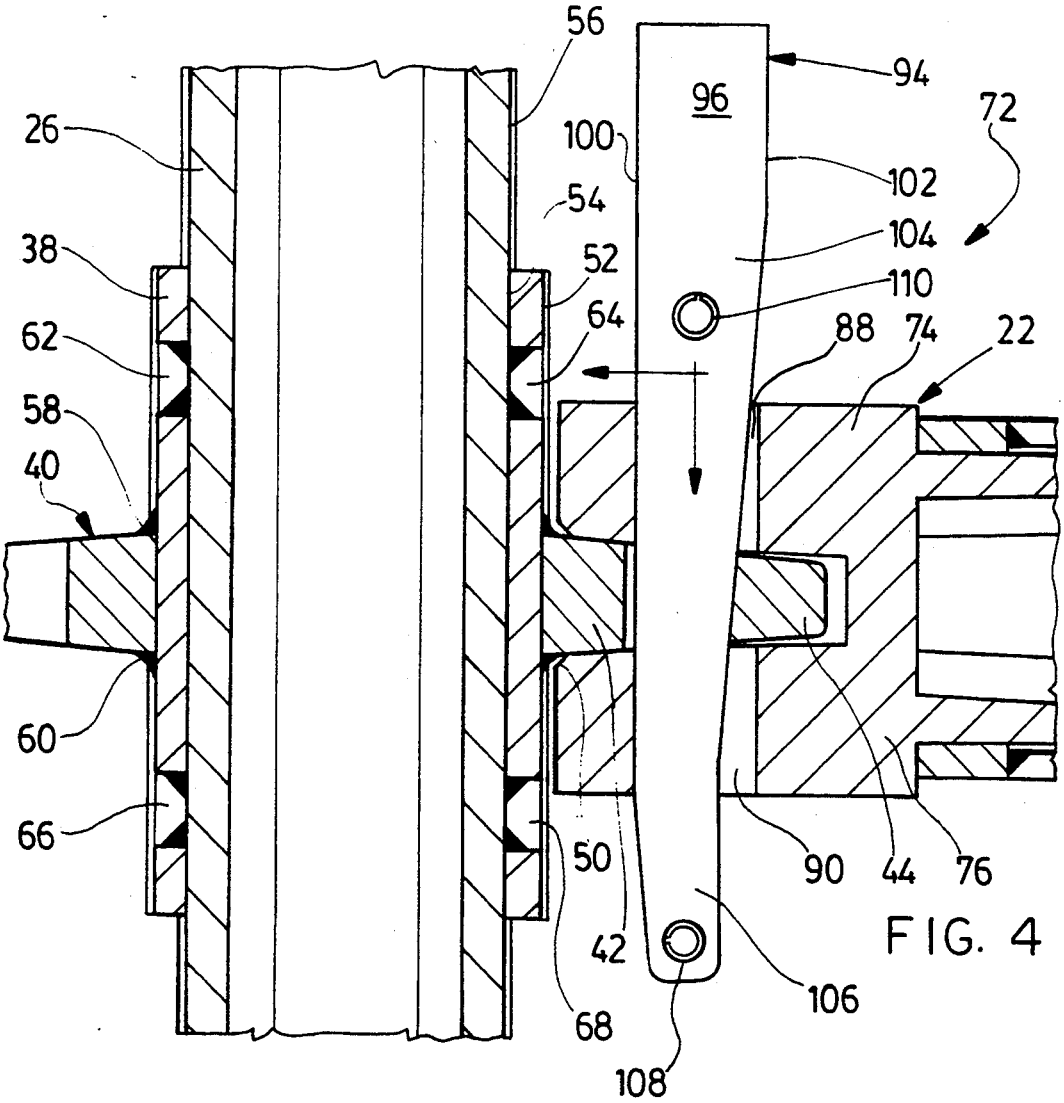
FIG. 4 is a view in vertical cross-section showing a brace connector and wedge cooperating with the flange assembly to form a joint between a brace and the upright.

The upright 12 is typical. It includes an extruded tubular aluminum post 26 on which are mounted four substantially identical aluminum flange assemblies 28, 30, 32, 34. The flange assembly 28 illustrated in FIGS. 2–8 is typical. It includes an extruded aluminum mounting sleeve 38 and a cast aluminum flange 40. The flange 40 has an annular central portion 42 which is comparatively thick and an annular peripheral portion 44 which is comparatively thin. The vertical thickness decreases continuously between the central and peripheral flange portions 42, 44, and the peripheral radial cross-section apparent in FIG. 4 is substantially uniform around the flange 40. The flange 40 has two sets of openings which are located intermediate the central and peripheral flange portions 42, 44. A cruciform opening 46 is typical of a first set and is intended to align a brace radially relative to the post 26. As apparent in FIG. 3, the cruciform opening 46 and three similar openings are spaced 90-degrees apart circumferentially for purposes of producing a rectangular gridwork characteristic of most scaffolds. Another opening 48 is typical of the second set and has a greater circumferential extent. Such openings are used to align braces at various angles relative to the post 26 and permit formation of a non-rectangular gridwork. The general principles underlying the use of such sets of openings are well know in the scaffold arts and will not be described further.

The post 26 and the sleeves and flanges of the associated flanges assemblies 28, 30, 32, 34 are formed with interlocking, complementary aligning structures. The object is to ensure, first, that flanges align properly with sleeves, and second, that sleeves align properly with the post 26. The overall result is that openings of all the flange assemblies 28, 30, 32, 34 are vertically registered.

The various aligning structures will be described with reference to the flange assembly 28. Its flange 40 is formed during casting with four internal alignment ribs which are spaced 90-degrees apart and are vertically oriented in the operative horizontal orientation of the flange 40. Only one such internal rib 50 has been specifically identified with a reference numeral, in FIGS. 3–5 and 8. The associated sleeve 38 is extruded with four external alignment grooves spaced 90-degrees apart and shaped to receive the internal alignment ribs of the flange 40 simultaneously in interlocking engagement. Only one such groove has identified with reference numeral 52, in FIGS. 3–5. The interior of the sleeve 38 is itself extruded with four internal alignment ribs spaced 90-degrees apart. Once again, only one such rib 54 is specifically identified, in FIGS. 3–5. The post 26 is extruded with four external alignment grooves (such as the groove 56 identified in FIGS. 3 and 4) spaced 90-degrees apart and shaped to receive the internal alignment ribs of the sleeve 38.

The flange 40 is first slipped onto one end of the sleeve 38 with the internal alignment ribs of the flange 40 interlocked with the external alignment grooves of the sleeve 38. The flange 40 is then displaced to a central position along the sleeve 38 and secured to the sleeve 38 with upper and lower weld beads 58, 60. The mounting sleeve 38 is then slipped over an end of the post 26, the internal alignment ribs of the sleeve 38 being mated in the process with the external alignment grooves of the post 26. The assembly 28 is then displaced to a desired vertical position on the post 26. The sleeve 38 is formed with four circumferentially-oriented slot 62, 64, 66, 68, two upper slots 62, 64 and two lower slots 66, 68, oriented horizontal in the operative orientation in FIG. 2. Weld beads are formed in each of the slots (such as the weld bead 70 in the slot 62) to secure the sleeve 38 to the post 26. As mentioned above, in the region where the welds are formed on the post 26, the post 26 is reinforced by the sleeve 38 of the flange assembly 28. The other flange assemblies 30, 32, 34 are similarly assembled and fixed in vertically spaced-apart relationship on the post 26.

Although the aligning structure of each component described comprises a set of four grooves or ribs, it will be appreciated that a single groove or rib would suffice and that the grooves and ribs of interlocking components can be interchanged. Also, the interlocking alignment structures can take any form that can be appropriately extruded longitudinally with the posts and sleeves and that can be cast or otherwise formed on the flanges.

Figure 5:
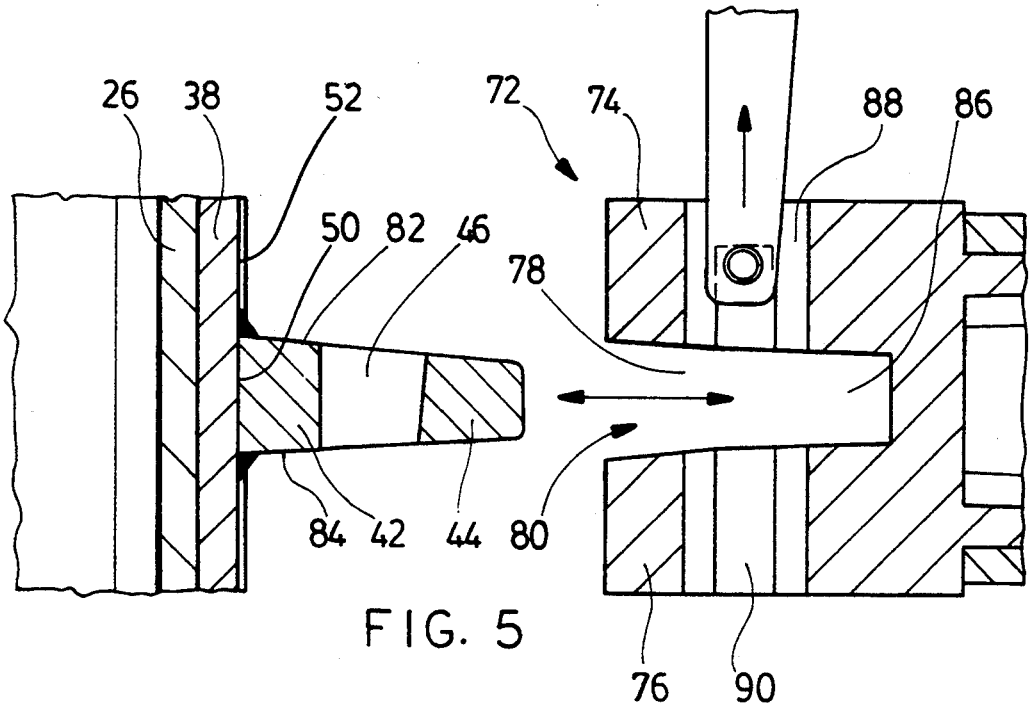
FIG. 5 is a fragmented view in vertical cross-section showing the joint released.

The joint 72 between the upright 12 and the brace 20 involving the flange assembly 28 and the cast aluminum connector 22 is shown in FIGS. 4 and 5 (respectively in closed and open states). The connector 22 has upper and lower sections 74, 76 defining a mouth 78 that receives the flange 40 (as in FIG. 4). The mouth 78 has an outer portion 80 shaped to seat in mating relationship on inclined upper and lower surfaces 82, 84 (identified in FIG. 5) of the central flange portion 42. An inner mouth portion 86 is shaped to remain clear of the flange 40. The connector 22 has a pair of aligned opening 88, 90, one opening 88 its upper section 74 and another opening 90 in the lower section 76. These opening 88, 90 are registered vertically with the opening in the flange 40, and a steel wedge 94 is inserted to secure the joint 72. The wedge 72 is shaped to force the mouth 78 of the connector 22 to seat firmly on the central flange portion 42. It will be noted that the lips of the mouth 78 have been slightly beveled to accommodate the weld beads 58, 60 securing the flange 40 to the sleeve 38.

The wedge 94 has a pair of opposing faces 96, 98 and a pair of opposing edges 100, 102 perpendicular to those faces 96, 98. It has a generally rectangular horizontal cross-section whose length decreases continuously between upper and lower end portions 104, 106 of the wedge 94. The lower end portion 106 is curved slightly to allow the wedge 94 to be struck with a hammer from below to release the joint 72 without contacting the post 26. A horizontal retaining pin 108 is press fit into an opening formed in the lower end portion 106 of the wedge 94 and extends perpendicularly from each of the opposing wedge faces 96, 98. A wear-indicating pin 106 is similarly mounted to the upper end portion 104 of the wedge 94.

The cross-sections of the various openings in the connector 22 and the flange 40 should be noted. The orientations indicated below are those occurring when the connector 22 has seated on the central flange portion 42 with relevant openings registered to receive the wedge 94. The major arm of the cross-section of the cruciform opening 46 of the flange 40 extends radially relative to the post 26 and defines the portion of the opening 46 that receives the wedge 94. The major arm decreases continuously in length from an upper end of the opening 46 to a lower end, as most apparent in FIGS. 4 and 5. The opposing edges 100, 102 of the wedge 94 converge in a corresponding manner and mate with flange surfaces defining opposing ends of the major arm, as apparent in FIG. 4. The cross-section of the cruciform opening 46 includes a minor arm sized to releasably receive and pass the retaining pin 108. It will be noted in FIG. 6 that the upper opening 88 of the connector 22 has a uniform upper horizontal cross-section which is rectangular and intended to accommodate the wedge 94. This extends radially relative to the post 26 (when the joint is secured with the wedge 94). It also has a uniform lower horizontal cross-section which is cruciform (as apparent from FIGS. 5 and 6). The major arm of that cross-section extends radially relative to the post 26 and is intended to accommodate the wedge 94. The transverse minor arm is sized to loosely receive and pass the retaining pin 108. The opening 90 in the lower section 76 of the connector 22 has a uniform cross-section which is cruciform, as most apparent in FIG. 6. The major arm once again accommodates the wedge 94 and the minor arm is sized to loosely receive and pass the retaining pin 108.

The configuration of the various openings permits the retaining pin 108 to pass through the openings in the lower connector section 76 and the flange 40, transversing the minor arms of the relevant cross-sections. The retaining pin 108 can enter the passage into the upper connector section 74 (as shown in FIG. 4) allowing the lower end portion 106 of the wedge 94 to clear the mouth 78 and permitting the connector 22 to be separated from the flange 40. However, the pin 108 lodges against an upper portion of the upper connector section 74. The wedge 94 is consequently retained permanently with the associated connector 22.

The wear-indicating pin 110 is positioned vertically on the wedge 94 such that the pin 110 normally locates no more than a predetermined distance (about $\frac{3}{8}$ of an inch) above an upper surface of the upper connector section 74 when the wedge 94 is fully inserted (as in FIG. 4). Only a predetermined measure of wear is tolerated in the wedge 94 and/or in the flange opening 46. When exceeded, the wear-indicating pin 110 contacts the upper surface of the upper connector section 74. This prevents the wedge 94 from being snugly inserted, which will be apparent to a workman. Since wear in the steel wedge 94 is less likely, this provides a positive indication that the associated upright 12 should be closely inspected and either repaired or replaced.

The pair of connectors 22, 24 associated with the brace 20 are aligned on the brace 20 in a precise manner. This is important in view of the precise fit between the mouth 78 of each connector and the two flanges to which the brace 20 must be connected. The mouths of the respective connectors 22, 24 should be substantially parallel. First, the brace 20 is extruded with a uniform interior surface and a pair of internal longitudinal ribs 120, 122 that constitute an aligning structure. The connector 22, which is typical, is formed with a male portion 124 that conforms to the interior surface of the brace 20. The male portion 124 has a pair of longitudinal external grooves 126, 128 that mate and interlock with the internal ribs 120, 122 of the brace 20. A circumferentially oriented slot 130 is formed in the brace 20 and overlays the male portion 124. A weld bead 132 in the slot 130 secures the male portion 124 to the brace 20. The other connector 24 is similarly aligned by the internal longitudinal ribs 120, 122. To facilitate handling of the brace 20, the brace 20 may be extruded with sets of closely-spaced fine grooves to enhance gripping.

It should be understood the connector 26 and wedge 94 may also be used to fasten one end of the brace 20 to the flange 40 in cooperation with one of the circumferentially wider flange openings, such as the opening 48. The connector mouth 78 would in such circumstances seat in substantially the same snug manner on the central flange portion 42, as has been described above. Also, as in prior practice, such connectors and flanges may be used to receive diagonal or vertical braces by appropriate configuration of brace ends and connectors. This may include provision of appropriate pivot joints between brace ends and connectors, as taught, for example, in U.S. Pat. No. 4,044,523.

Figure 6:
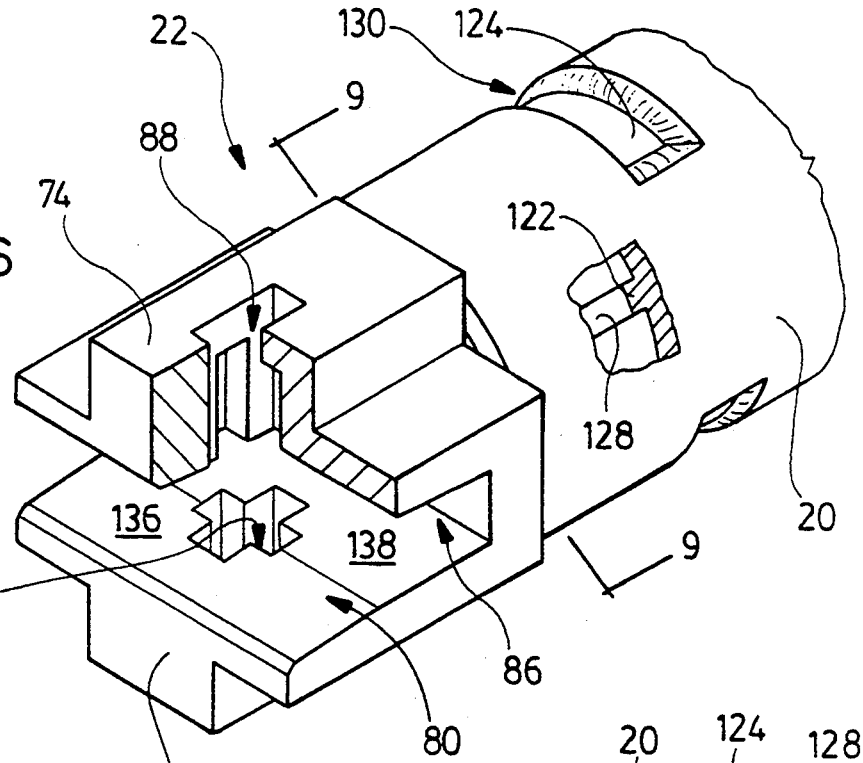
FIG. 6 is a fragmented perspective view of the connector.
Figure 7:
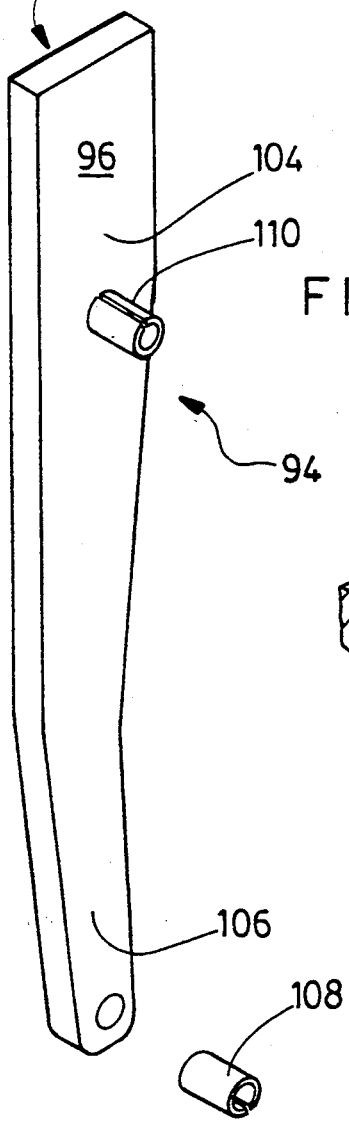
FIG. 7 is a perspective view of the wedge.
Figure 9:
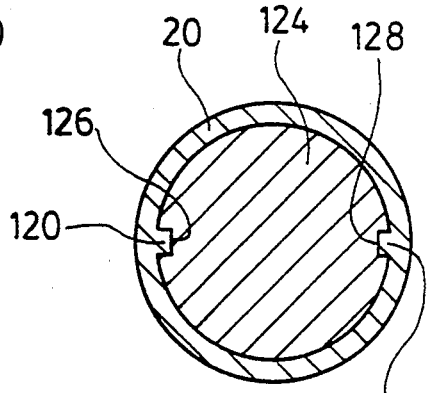
Figure 8:
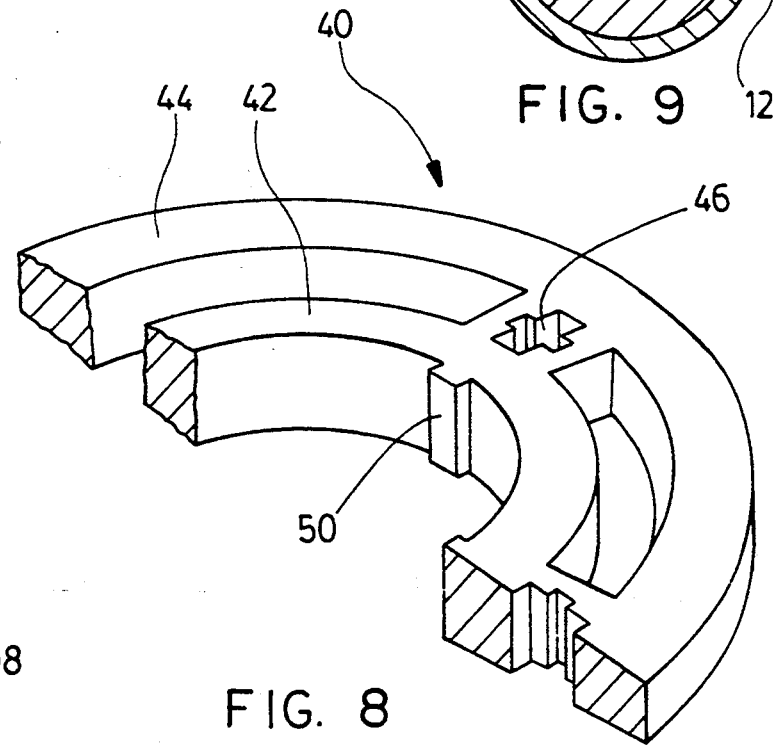
FIG. 8 is a fragmented perspective view further detailing a flange associated with the flange assembly; and, FIG. 9 is a sectional view along lines 9—9 of FIG. 6 showing aligning structure use to position the connector on a brace end.
Figure 10:
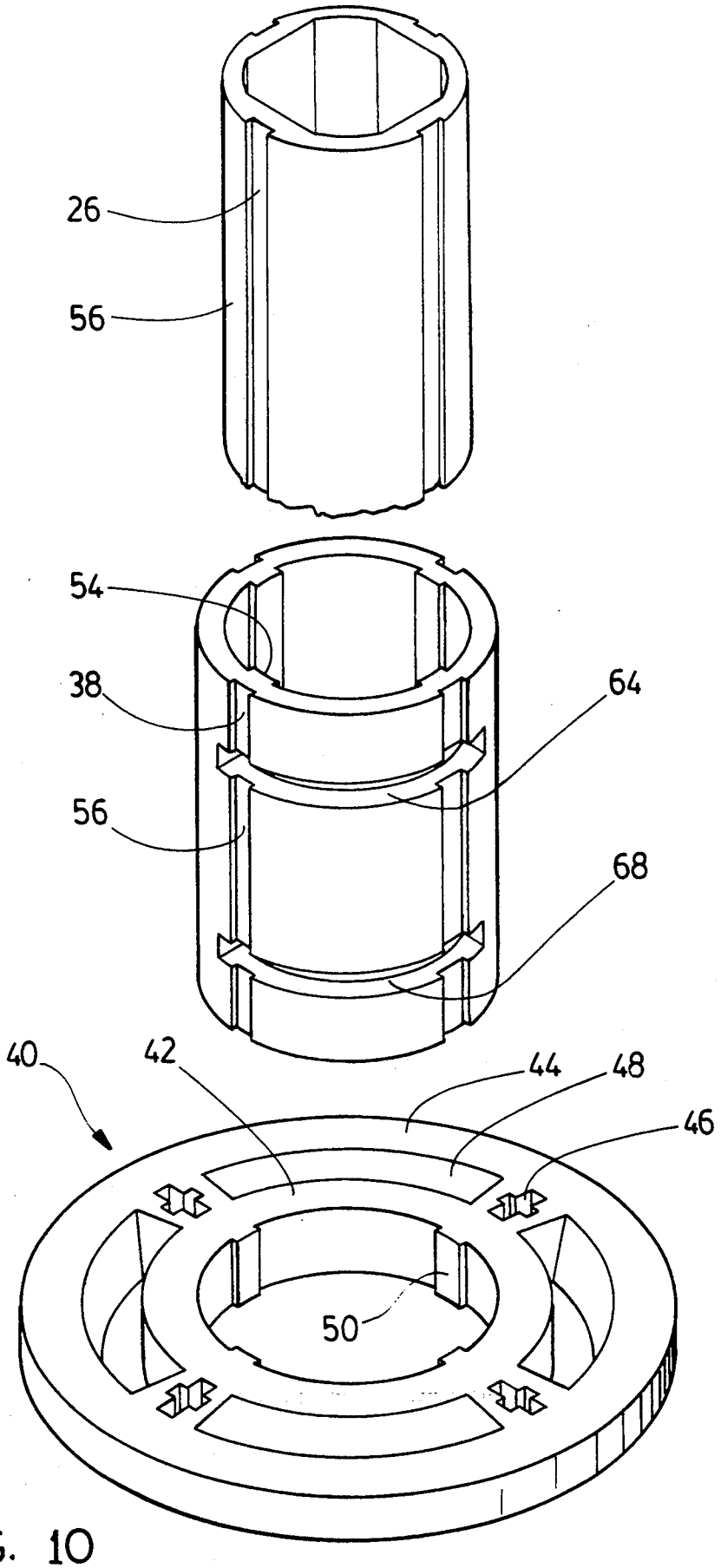
FIG. 10 is an exploded view further illustrating the complementary interlocking nature of the various components of the upright.
Figure 11:
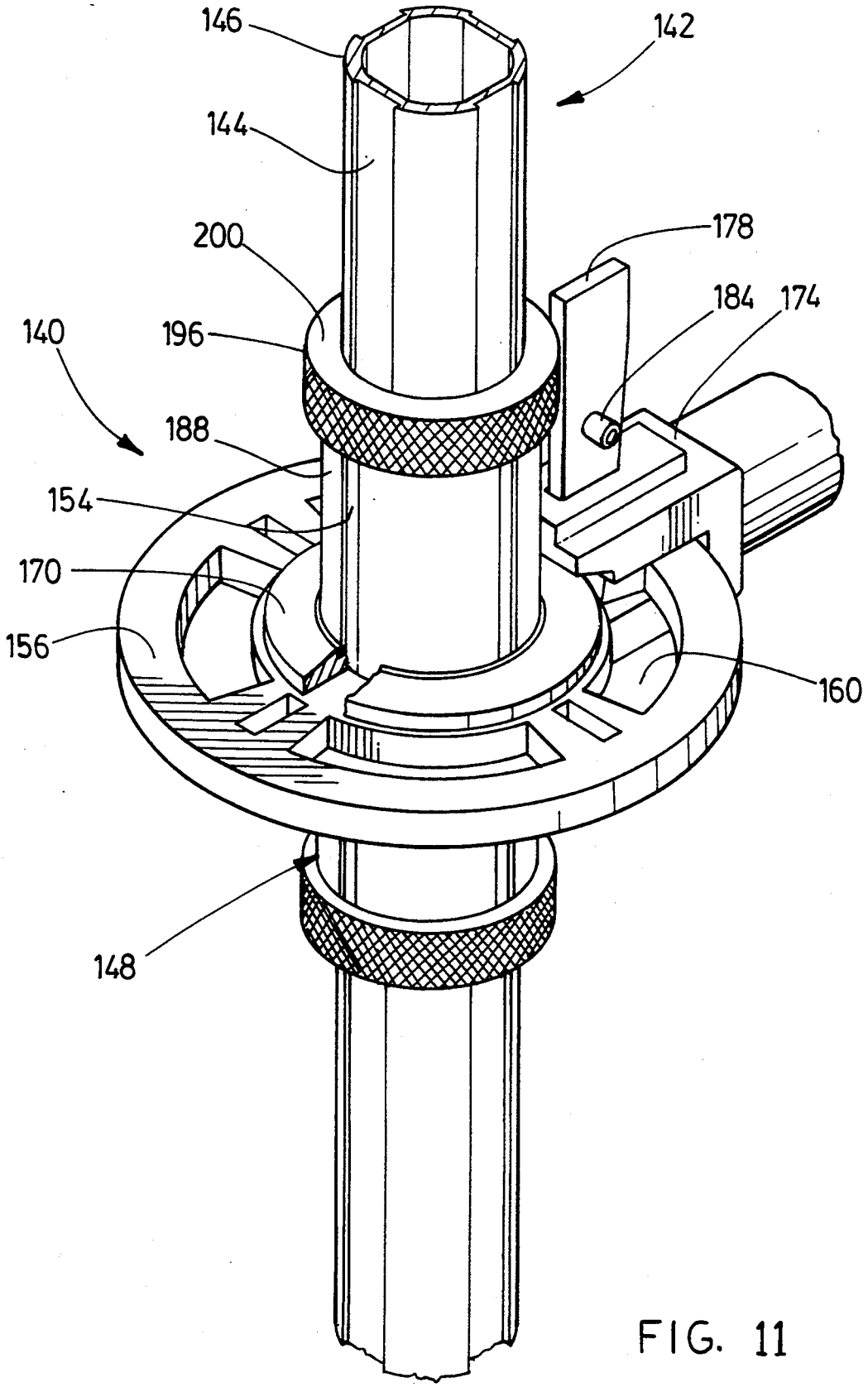
FIGS. 11–14 are views showing an alternative post and flange assembly, constructed to permit the flange assembly to be positioned as desired along the post.
Figure 12:
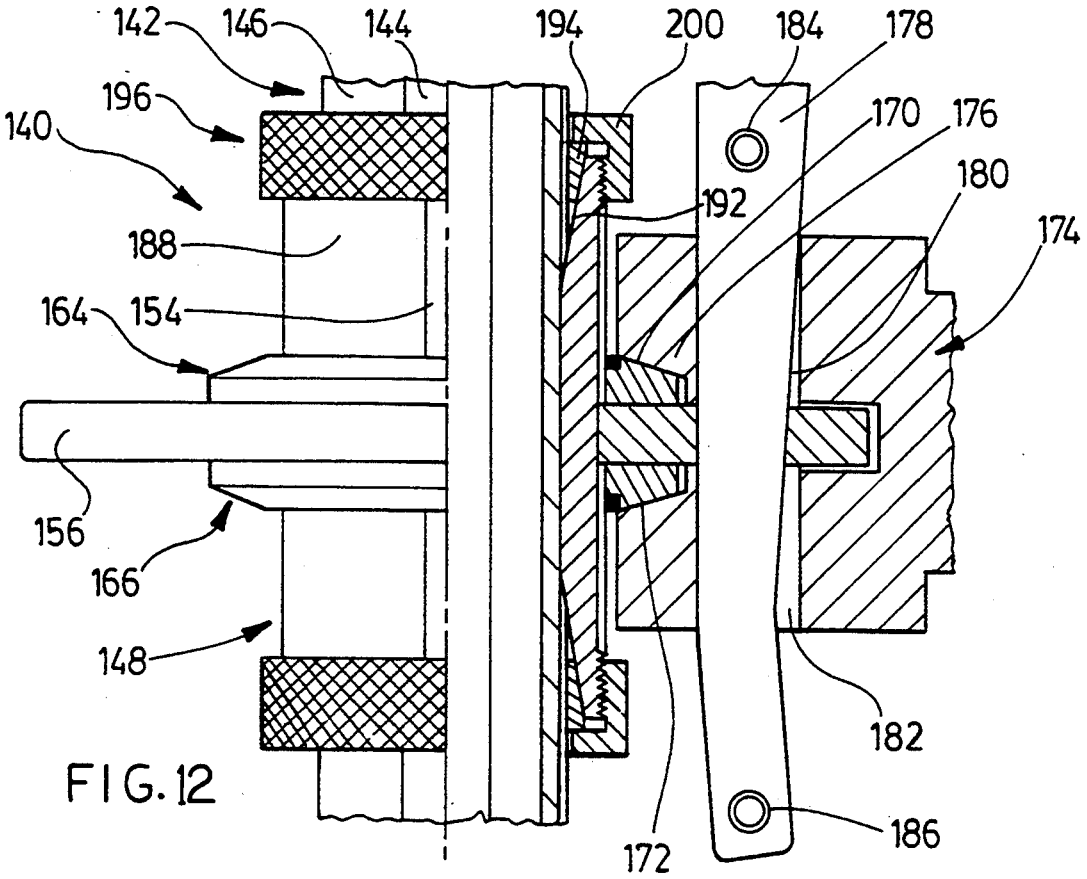
Figure 13:
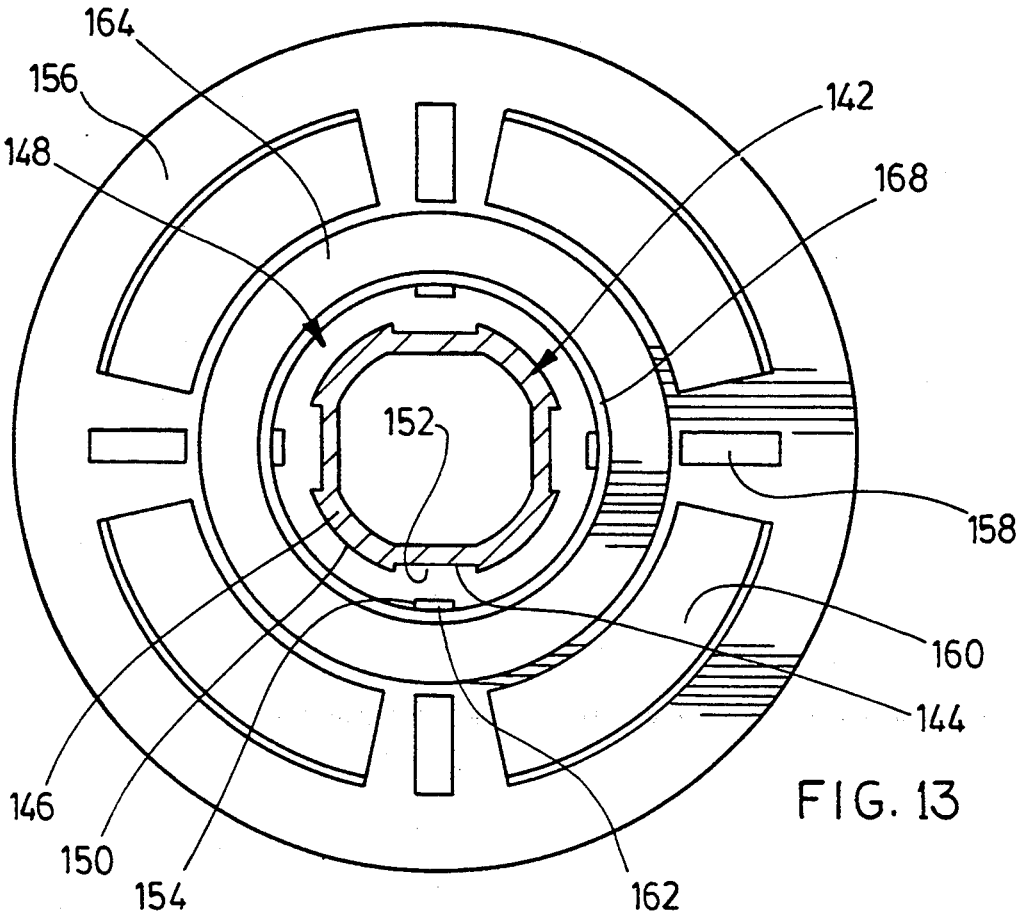
Figure 14:
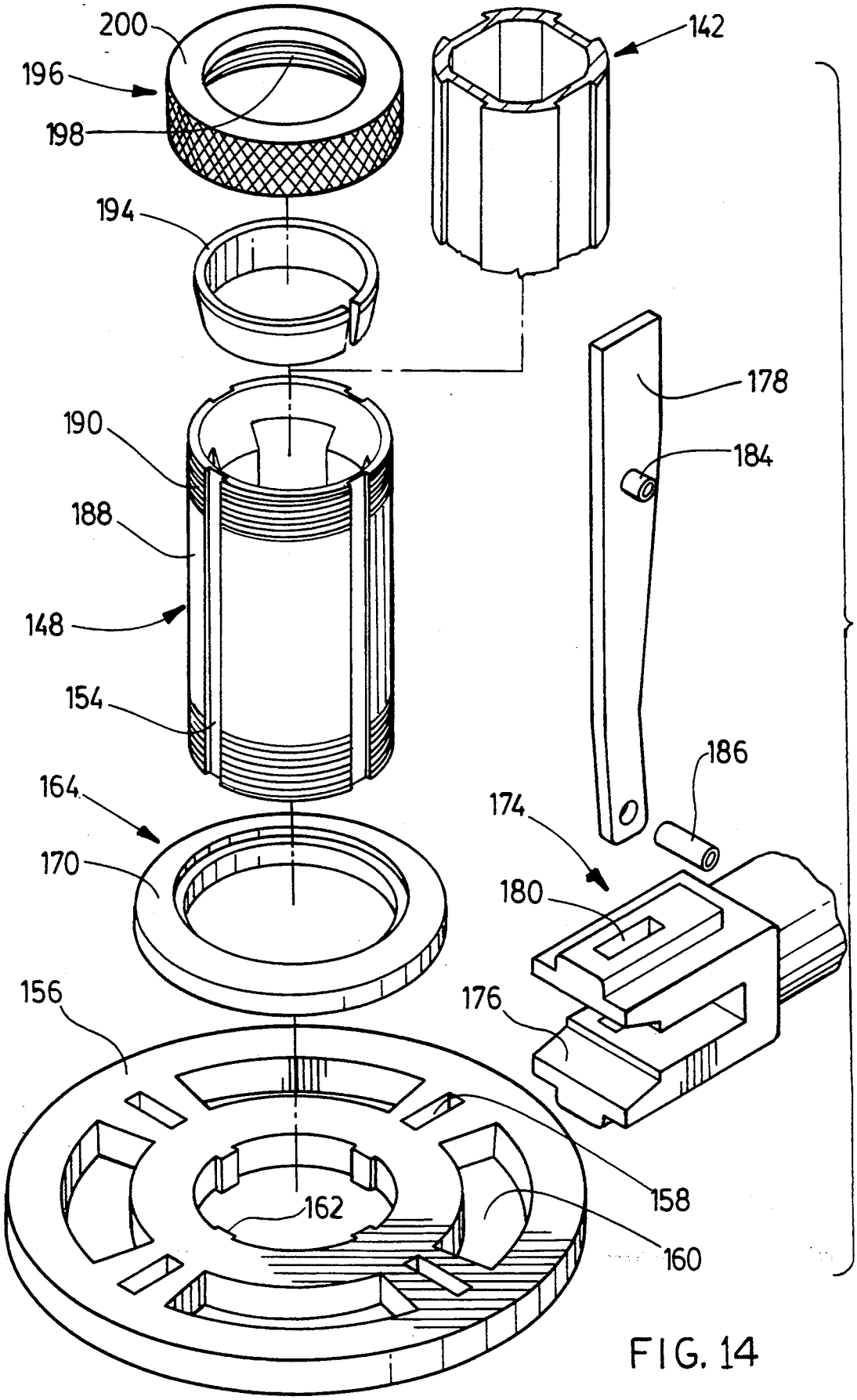

It should be noted that the interior surfaces of the connector 22 defining the mouth 78, such as two lower surfaces 136, 138 indicated in FIG. 6, are planar. The surface 136 in part defines the outer mouth portion 80. It consequently mates with the lower surface portion 84 of the central flange portion 42 in essentially a straight-line (radial) contact. The surface 136 and a corresponding upper surface (not indicated) defining the outer mouth portion 80 may, however, be at least partially shaped to conform to a larger expanse of the upper and lower flange surface portions 82, 84 with which they mate. It is not then absolutely necessary that the connector 22 be brought into proximity of the flange 40 strictly in a radial direction before inserting the wedge 94. In practice, as in prior art systems, the wedge 94 may drive the connector 22 radially through some distance, placing the brace 20 in tension, before the joint 72 is fully secured (assuming that the other connector 24 of the brace 20 has already been secured to another upright). This permits a measure of flange-conforming surface to be cast into the upper and lower sections 74, 76 of the connector 22.

Reference is made to FIGS. 11–14 which illustrate another aluminum flange assembly 140 and post 142 that might be used in the scaffold system of FIG. 1. The exterior of the post 142 is extruded with a set of alternating grooves and ribs (only one groove 144 and one rib 146 specifically indicated) that serve as an aligning structure. The flange assembly 140 comprises an aluminum sleeve 148 extruded with complementary set of alternating grooves and ribs (such as the groove 150 and the rib 152 apparent in FIG. 13) that interlock with the external set of the post 142. The exterior of the sleeve 148 is extruded with four longitudinal grooves spaced 90 degrees apart (only one groove 154 specifically indicated) that serve as an aligning structure for an annular aluminum flange 156. The flange 156 has four radial openings (such as the opening 158 apparent in FIG. 13) spaced at 90 degree intervals. The radial openings cooperate with connectors associated with braces (only one aluminum connector 174 with wedge 178 being illustrated) to secure braces at right angles to one another. It also has four openings with greater circumferential extent (such as the opening 160) that permit the same type of connector to join a brace in various angular orientations to the post 142. The flange 156 is formed with four internal ribs (such as the rib 162 apparent in FIGS. 13 and 14) complementary in shape to and interlocking with the external grooves of the sleeve 148 thereby constraining the orientation of the openings of the flange 156.

The flange 156 in this instance is a plate-like member formed by extrusion and transverse cutting. This is considerably less expensive than casting. It is secured to the sleeve 148 solely with a pair of annular retaining members 164, 166. Each of the retaining members 164, 166 is simply butted against one of the axially opposing faces of the flange 156 and then welded to the sleeve 148 as indicated, for example, at 168. A major advantage of such construction is that the aluminum flange 156 is not weakened by direct application of heat. The retaining members 164, 166 define a pair of annular surfaces 170, 172 that are inclined relative to the general plane of the flange 156 and that are located on axially opposing sides of the flange 156. The connector 174, which is similar to the brace connector described above, has a mouth portion 176 shaped to mate with the inclined surfaces 170, 172, as apparent in FIG. 12. The wedge 178 is once again shaped to seat the mouth portion 176 firmly against the inclined annular surfaces 170, 172, as the wedge 178 is introduced through aligned openings 180, 182 in the connector 174 and a registered opening 158 in the flange 156. This once again ensure a snug fit. It also directs bending forces away from the periphery of the aluminum flange 156. The wedge 178 once again has a wear-indicating pin 184 and a retaining pin 186, functioning substantially as described above.

The flange assembly 140 releasably secures to the post 142. The upper end portion of the sleeve 148 is adapted to grip the post 142. To that end, the upper sleeve end portion 188 is formed with an external screw thread 190 (apparent in FIG. 15). The inner surface 192 of the upper sleeve end portion 188 is flared, as apparent in FIGS. 12 and 14. An annular brass wedge ring 194 is located between the flared internal surface 192 and the exterior of the post 142. The wedge ring 194 is split, as apparent in FIG. 14, to allow it to expand and contract radially. A knurled stainless steel end cap 196 with an internal screw thread 198 is threaded to the external screw thread 190. The cap 196 has an annular flange 200 that engages the wedge ring 194. Rotating the cap 196 clockwise (as view from above) displaces the wedge ring 194 axially, jamming it between the flared internal surface 192 and the post 142. Counterclockwise rotation releases the wedge ring 194 from the jam fit, allowing the wedge ring 194 and entire flange assembly 140 to be displaced by hand along the post 142. The lower sleeve end portion is similarly adapted to grip the post 142. A principal advantage of this arrangement is that the number of flange assemblies can be reduced. A pair of such flange assemblies can be mounted with their sets of openings immediately registered on the post 142, and displaced to positions appropriate for the particular scaffold being erected.

Figure 15:
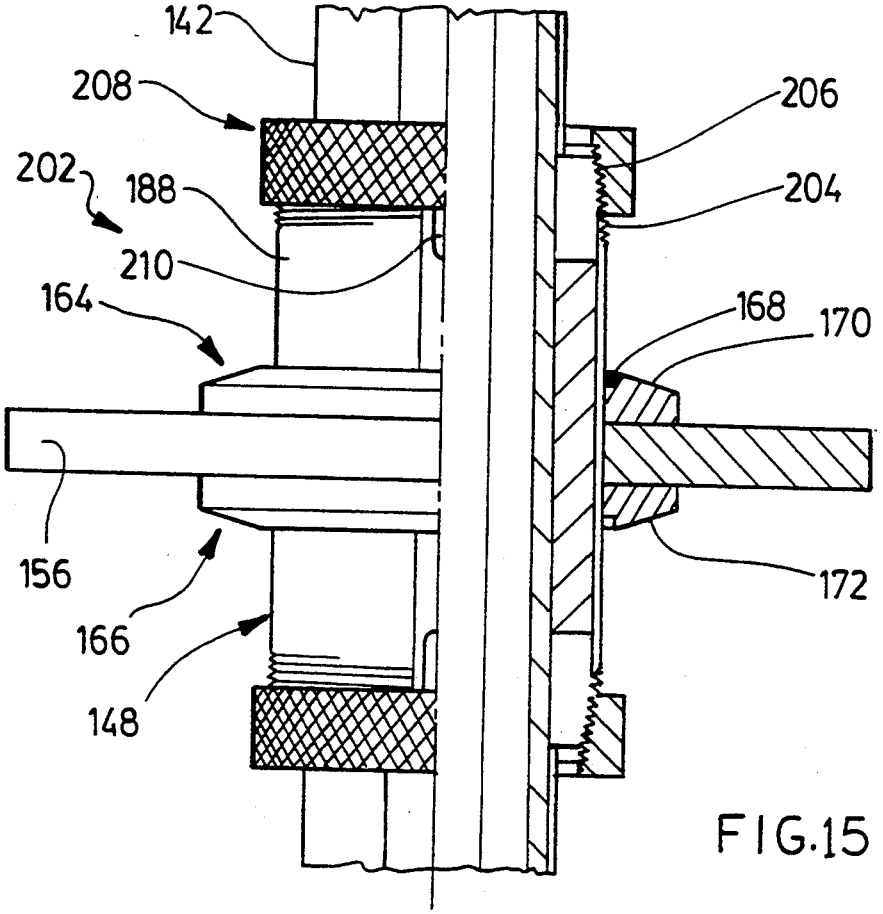
FIG. 15 is an elevational view in partial cross-section showing another flange assembly that can be releasably secured at various positions along the post; and, FIG. 16 is a fragmented elevational view in partial cross-section showing yet another flange assembly that can be releasably secured at various positions along the post.

FIG. 15 illustrates an alternative flange assembly 202 that can be mounted on the post 142 of FIGS. 11–14. Components identical to those of the flange assembly 140 above have been identified with the same reference numerals. The principal difference between the two flange assemblies 140, 202 resides in the means used to releasably secure the flange assembly 202 to the post 142. The upper sleeve end portion 188 is typical. It has an external screw thread 204 that mates with the internal screw thread 206 of a knurled, annular, stainless steel member 208. The screw threads 204, 206 are tapered such that rotating the knurled member 208 clockwise (as viewed from above) contracts the upper sleeve end portion 188 radially, forcing it to grip the post 142. To permit such radial contraction, the upper sleeve end portion 188 is formed with four longitudinal slots, spaced 90 degrees apart and open at the upper edge of the sleeve 148. Only one such slot 210 has been specifically identified in FIG. 15. The lower sleeve end portion is similarly constructed to grip the post 142.

Figure 16:
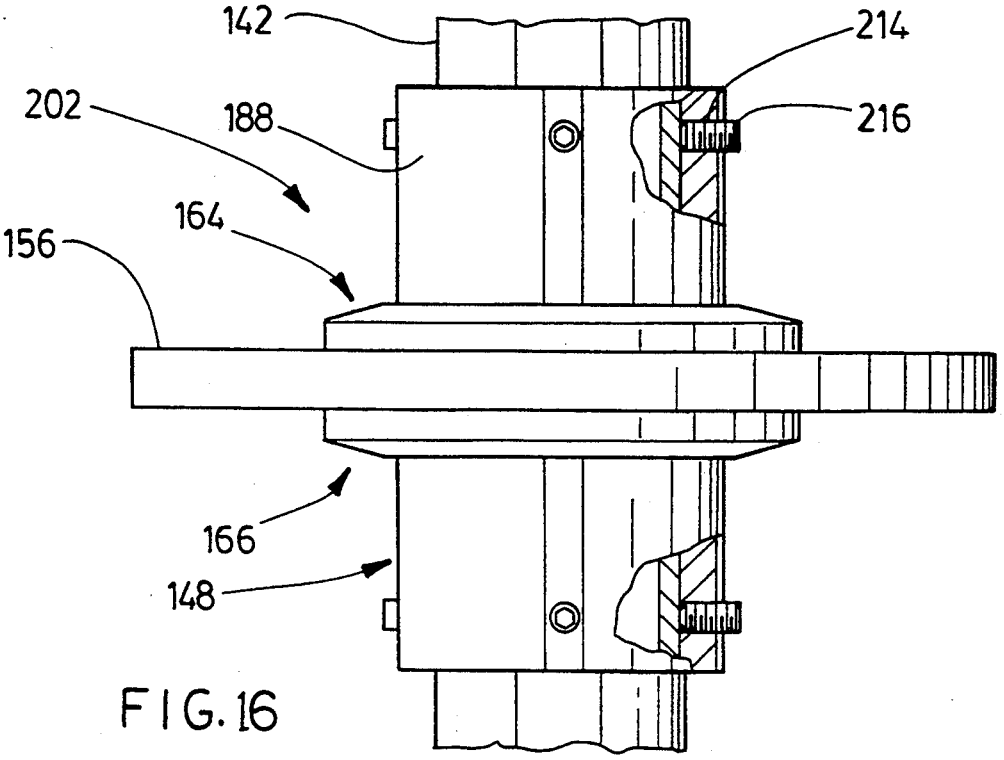

FIG. 16 illustrates yet another flange assembly 212 that can be mounted on the post 142 of FIGS. 11–14 for positioning at different locations along the post 142. Components common to the flange assemblies of FIGS. 11–15 are once again identified with the same reference numerals. The principal difference relates once again to how the flange assembly 212 releasably fastens to the post 142. In this embodiment, the upper sleeve end portion 188 is formed with four threaded apertures that receive set screws. Only one such aperture 214 and set screw 216 are specifically identified in FIG. 15. The set screw 216 can be engaged and disengaged from the post 142 by selective rotation in an appropriate direction. It should be noted that the flange assembly 140 of FIGS. 11–15 is strongly preferred. The flange assembly 140 is faster and simpler to secure and release, and is less likely to damage the relatively soft aluminum of the post 142. The lower sleeve end portion is similarly formed with threaded apertures and set screws.

It will be appreciated that a particular embodiment of the invention has been described and that modifications may be made therein without departing from the spirit of the invention.

I claim:

1. A scaffold comprising:

a plurality of uprights, each of the uprights comprising a tubular aluminum post extruded with a longitudinal aligning structure along its exterior and a plurality of flange assemblies associated with the post, each of the flange assemblies comprising an aluminum sleeve located about the associated post and extruded internally with a longitudinal aligning structure complementary to the aligning structure of the associated post, an annular aluminum flange mounted around the sleeve and formed with a set of openings in a predetermined spacing arrangement, means fixing the flange to the sleeve against relative rotation and relative longitudinal displacement, and means securing the sleeve to the associated post, the aligning structure of each of the flange assemblies being interlocked with the aligning structure of the post such that the sets of openings of the flange assemblies are in registration; and, a plurality of elongate braces for joining the uprights, each of the braces comprising a pair of connectors each at a different end of the brace, each of the connectors comprising a mouth portion shaped to receive a flange of any one of the uprights, a pair of aligned openings in the mouth portion positioned to register with one of the openings of the received flange, and a wedge shaped for insertion through the registered openings thereby to secure the connector to the received flange.

2. The scaffold of claim 1 in which the securing means of each of the flange assemblies of each of the uprights releasably secure the sleeve of the flange assembly to the associated post such that the position of the flange assembly along the associated post may be selected by sliding the flange assembly along the associated post with the internal aligning structure of its sleeve interlocked with the aligning structure of the associated post thereby maintaining registration among the sets of openings of the flange assemblies on the associated post.

3. The scaffold of claim 2 in which, in each of the flange assemblies of each of the uprights, the securing means comprise:

an external screw thread formed on an end portion of the sleeve and a plurality of slots formed in the sleeve end portion and oriented to permit the sleeve end portion to contract radially; and, a generally annular member formed with an internal screw thread threaded to the external screw thread of the sleeve end portion;

the internal and external screw threads being shaped such that rotation of the annular member in one direction contracts the sleeve radially to grip the associated post and rotation of the annular member in an opposite direction releases the sleeve from the associated post.

4. The scaffold of claim 1 in which in each of the flange assemblies of each of the uprights, the securing means comprise:

an external screw thread and a flared internal surface formed on an end portion of the sleeve of the flange assembly;

an annular wedge split to contract radially and located between the flared internal surface and the post associated with the flange assembly; and, a cap comprising an internal screw thread mated with the external screw thread of the sleeve end portion, the cap being shaped to engage the annular wedge such that rotation of the cap in one direction jams the wedge between the flared internal surface and the post associated with the flange assembly and rotation of the cap in an opposite direction permits the wedge to be released from between the flared internal surface and the associated post for sliding movement along the associated post.

5. The scaffold of claim 1 in which in each of the flange assemblies of each of the uprights, the securing means comprise a threaded aperture formed in the sleeve of the flange assembly and a set screw threaded into the threaded aperture such that the set screw engages and disengages from the post associated with the flange assembly in response to selective rotation of the set screw.

6. The scaffold of claim 1 in which in each of the flange assemblies of each of the uprights:

the sleeve is extruded with an external aligning structure; and, the flange comprises an aligning structure complementary to and interlocked with the external aligning structure of the sleeve.

7. The scaffold of claim 6 in which each of the flange assemblies of each of the uprights comprises a pair of aluminum annular retaining members securing the flange in a predetermined axial position relative to the sleeve, the retaining members being located about the sleeve and against axially opposing faces of the flange and being welded to the sleeve.

8. The scaffold of claim 7 in which:

in each of the flange assemblies of each of the uprights, the retaining members define a pair of annular surfaces on opposing sides of the flange that are inclined relative to a general plane of the flange; and, in each of the connectors of each of the braces, the mouth portion of the connector is shaped to seat in mating relationship with the inclined annular surfaces defined by the retaining members of any one of the flanges received by the connector.

9. The scaffold of claim 1 in which in each of the connectors of each of the braces, the wedge comprises a pin extending perpendicularly from the wedge, the pin being positioned normally to locate no more than a predetermined distance above an upper surface of the connector when the wedge is fully inserted through the pair of aligned openings of the connector thereby preventing the wedge from being snugly inserted through the connector when the aligned openings in the connector are excessively worn or when a flange opening registered with the aligned openings is excessively worn.

10. The scaffold of claim 1 in which in each of the flange assemblies of each of the uprights, the sleeve comprises a slot overlaying the associated post and the securing means comprise a weld bead formed in the slot and joining the sleeve to the associated post.

11. An upright for use in a scaffold, comprising:

a tubular aluminum post extruded with a longitudinal aligning structure along its exterior;

a plurality of flange assemblies, each of the flange assemblies comprising an aluminum sleeve located about the post and extruded internally with a longitudinal structure complementary to the aligning structure of the post, an annular aluminum flange mounted around the sleeve and formed with a set of openings in a predetermined spacing arrangement, means fixing the flange to the sleeve against relative rotation and relative longitudinal displacement, and means securing the sleeve to the post, the aligning structure of each of the flange assemblies being interlocked with the aligning structure of the post such that the sets of openings of the flange assemblies are in registration.

12. The upright of claim 11 in which the securing means of each of the flange assemblies releasably secure the sleeve of the flange assembly to the post such that the position of the flange assembly along the post may be selected by sliding the flange assembly along the post with the internal aligning structure of its sleeve interlocked with the aligning structure of the post thereby maintaining registration among the sets of openings of the flange assemblies.

13. The scaffold of claim 12 in which, in each of the flange assemblies, the securing means comprise:

an external screw thread formed on an end portion of the sleeve and a plurality of slots formed in the sleeve end portion and oriented to permit the sleeve end portion to contract radially; and, a generally annular member formed with an internal screw thread threaded to the external screw thread of the sleeve end portion;

the internal and external screw threads being shaped such that rotation of the annular member in one direction contracts the sleeve radially to grip the post and rotation of the annular member in an opposite direction releases the sleeve from the associated post.

14. The scaffold of claim 12 in which in each of the flange assemblies, the securing means comprise:

an external screw thread and a flared internal surface formed in end portion of the sleeve of the flange assembly;

an annular wedge split to contract radially and located between the flared internal surface and the post; and, a cap comprising an internal screw thread mated with the external screw thread of the sleeve end portion, the cap being shaped to engage the annular wedge such that rotation of the cap in one direction jams the wedge between the flared internal surface and the post and rotation of the cap in an opposite direction permits the wedge to be released from between the flared internal surface and the post for sliding movement along the post.

15. The scaffold of claim 12 in which, in each of the flange assemblies, the securing means comprise a threaded aperture formed in the sleeve of the flange assembly and a set screw threaded into the threaded aperture such that the set screw engages and disengages from the post in response to selective rotation of the set screw.

16. The scaffold of claim 10 in which, in each of the flange assemblies:

the sleeve is extruded with an external aligning structure; and, the flange comprises an aligning structure complementary to and interlocked with the external aligning structure of the sleeve.

17. The scaffold of claim 16 in which, in each of the flange assemblies, the annular flange is secured axially to the sleeve solely by a pair of annular aluminum retaining members, each of the retaining members being located about the sleeve and against a different axially opposing face of the flange and being welded to the sleeve.

18. The scaffold of claim 10 in which, in each of the flange assemblies, the sleeve comprises a slot overlaying the post and the securing means comprise a weld bead formed in the slot and joining the sleeve to the post.

* * * * *